United States Patent [19]

Shaw

[11] 4,326,357

[45] Apr. 27, 1982

[54] MODEL LOCOMOTIVE SUSPENSION SYSTEM

[75] Inventor: Christopher W. Shaw, Kirkbymoorside, England

[73] Assignee: Micro Metalsmiths Limited, N. Yorkshire, England

[21] Appl. No.: 140,613

[22] Filed: Apr. 15, 1980

[30] Foreign Application Priority Data

Apr. 19, 1979 [GB] United Kingdom ..... 13615/79

[51] Int. Cl.[3] ..... A63H 19/02

[52] U.S. Cl. ..... 46/217; 105/82

[58] Field of Search ..... 46/217, 218, 216; 105/194, 195, 82

[56] References Cited

U.S. PATENT DOCUMENTS 907,822 12/1908 Larson ..... 105/82

1,642,891 9/1927 Pflager ..... 105/195

2,121,782 6/1938 Barclay ..... 105/82

2,241,396 5/1941 Fahlstrom et al. ..... 105/82

*Primary Examiner*—Robert Peshock

*Assistant Examiner*—Mickey Yu

*Attorney, Agent, or Firm*—Brisebois & Kruger

[57] ABSTRACT

An equalized or compensated suspension system is reproduced in a model of a locomotive and comprises an arrangement of levers and/or dummy leaf springs which are interconnected by links so as to imitate the suspension system of the original locomotive. The model locomotive has a chassis and generally vertically reciprocable wheel axles mounted along the chassis. Springs are disposed in housings fixed to the model's chassis and are arranged to act at opposite ends on the wheel axles and associated levers or dummy leaf springs of the suspension system.

1 Claim, 2 Drawing Figures

MODEL LOCOMOTIVE SUSPENSION SYSTEM

BACKGROUND OF THE INVENTION

The present invention relates to model locomotives or railway engines and, more particularly, to scale model steam locomotives.

Steam locomotives, which are reproduced as models, were often fitted with a so-called equalized or compensated suspension system, the purpose of which was to enable the locomotive to travel uneven track whilst maintaining an approximately equal weight on each wheel mounted by the suspension system. Such an equalized or compensated suspension system is illustrated in FIG. 1 of the accompanying drawings. Referring to FIG. 1, the driving wheels 1 of the locomotive, which for clarity are only illustrated in broken outline, are driven by a steam cylinder 2 mounted at the front of the locomotive chassis 3 and connected to the wheels 1 by driving rods 4 in any conventional manner. Each driving wheel is fixed to an axle 5 which is journalled adjacent the wheel in an axle bush 6 slidably mounted on bearing surfaces provided on the adjacent main longitudinal chassis member 7 so as to be able to reciprocate vertically. The top of each bush is contacted by a pillar 8 which is vertically slidable in a holder 9 and has its upper end in contact with the middle of the bottom of a leaf spring 10 spanning the axle. This leaf spring is connected at its opposite ends to vertical links 11 which are, themselves, connected to the ends of compensating levers 12 rockably on appropriate pivots on brackets 13 fixed to the chassis member 7. The opposite ends of the compensating levers are connected by further vertical links to adjacent leaf springs, and so on.

It can be seen that this system of springs, levers and links enables a driving wheel to move in a vertical plane whilst to some extent sharing the alteration in spring pressure caused thereby with the leaf springs associated with adjacent driving wheels. This causes an alteration in pressure on these adjacent wheels. Furthermore, it will be apparent that this alteration affects the next sets of wheels, if any.

FIG. 1 also illustrates some modifications of the basic suspension system. Hence, at the front of the chassis, link 14 is not pivoted at the central point and this modification allows for equalisation or compensation due to an equal weight distribution along the length of the locomotive. At the rear of the chassis, a modification is shown in which the position of the leaf spring 10 and lever 12 are reversed compared with the basic system described above. Coil springs have also been used instead of or as well as leaf springs.

In the case of a model locomotive, it is feasible to reproduce exactly the details of a compensated suspension system in scales down to approximately one twentieth of full size. Some attempt has also been made to reproduce a compensated suspension system, as described above, in a scale locomotive of one forty-eighth full size but, in this model, the leaf springs were made as small castings so that, although an equalizing action was obtained, there was no spring or "give" in the suspension system.

In scale model locomotives down to approximately one eighty-seventh full size, it has been standard practice to provide for independent axle springing by means of small fixed coil springs bearing on the axle bushes. For increased realism of the suspension system, fixed dummy or immitation leaf springs and, sometimes also, dummy associated compensating levers, have been fitted. Such a construction provides a spring suspension system without equalization.

In some models, it is also known to provide a spring suspension system with partial equalization by using an arrangement of wires firmly fixed to appropriate points on the chassis and bearing on some or all the axle bushes. Such a system, however, does not produce an appearance representative of the original.

SUMMARY OF THE INVENTION

It is an object of the present invention to provide a model of a locomotive of the type fitted with an equalized or compensated suspension system in which the model suspension system, in appearance and effect, works in a manner more accurately corresponding to the original or full size locomotive than has hitherto been the case in models.

The present invention consists in a model of a locomotive fitted with an equalized or compensated suspension system, wherein the wheel axles of the model are mounted on the models' chassis so as to be reciprocable substantially vertically, a system of levers and/or dummy leaf springs interconnected by links are arranged in a manner representing the suspension system of the original locomotive, and resilient means disposed in housings fixed to the chassis are arranged to act at opposite ends on the axles and associated levers or leaf springs, respectively.

The resilient means may bear at one end against the associated lever or leaf spring and at its opposite end against a bearing bush for the axle slidably mounted on the chassis. Preferably, the resilient means comprise compression coil springs located in tubular housings fixed to the chassis. Also preferably, the housings conceal the coil springs or other resilient means.

It will be appreciated that the Figures only illustrate the suspension for the the wheels on one side of the full-size and model locomotives, respectively, and that the suspension is duplicated on the opposite sides.

DETAILED DESCRIPTION OF THE DRAWINGS

Figure 1:
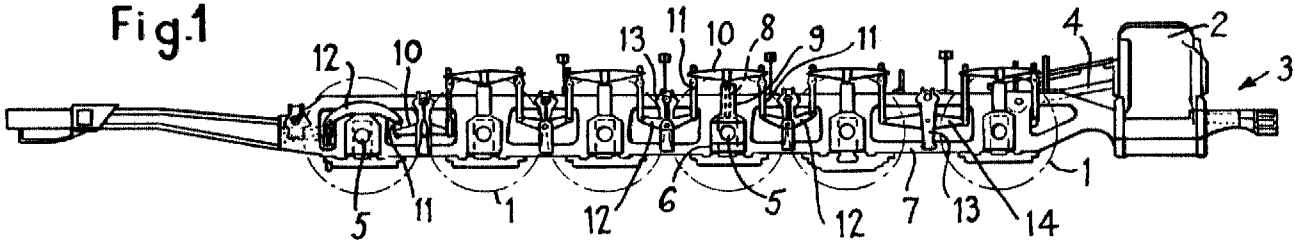
FIG. 1 is a side elevation illustrating the suspension system of a full-size locomotive.
Figure 2:
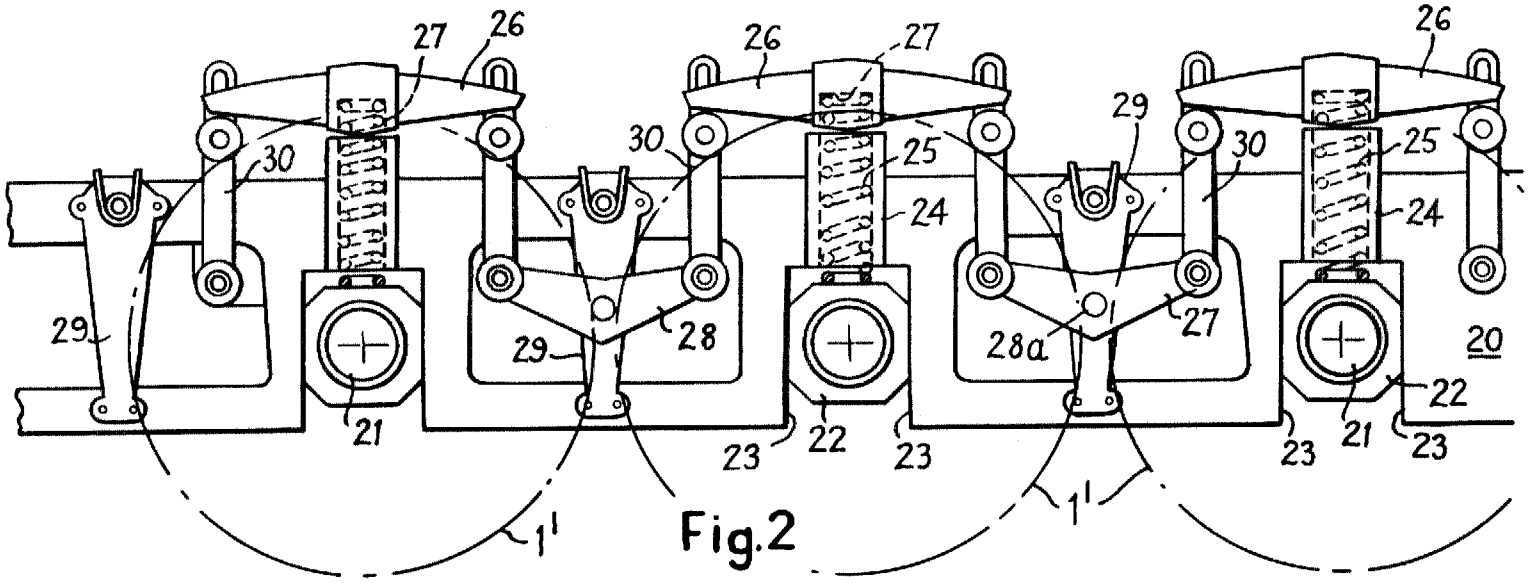
FIG. 2 is a side elevation illustrating a model suspension system constructed in accordance with the invention.

Referring to FIG. 2, 20 is a part of one of the main longitudinal chassis members of the locomotive. The axles 21 of three pairs of driving wheels 1' are journalled at opposite ends in axle bushes 22 which are slidably mounted on bearing surfaces 23 in the main longitudinal chassis members 20 so as to be reciprocable vertically. Secured to the chassis members above each axle bush is a vertical tubular housing 24 representing a holder of the full size system containing a compression coil spring 25. A dummy or immitation leaf spring 26 is rockably supported on the upper end of each housing in spanning relation with the associated axle and the upper end of the coil spring 25 fits into a recess 27 in the bottom of the leaf spring whilst its lower end bears on the associated axle bush 22. Each dummy leaf spring 26 is a rigid device representing a multi-leaf spring and it can move up and down, as well as rock, on the top of its associated spring housing 24. The rating of each coil spring is selected so that the weight of the locomotive compresses the spring to a suitable working length.

Compensating levers 28 are rockably mounted between the axle bushes 22. Similarly to the real suspension system, they are mounted on pivots 28*a* projecting from brackets 29 fixed to the main chassis member 20. Opposite ends of the compensating levers are connected to adjacent dummy leaf springs 26 by links 30, themselves pivoted at opposite ends to the levers and the leaf springs. The outer ends of the outer leaf springs are not connected to compensating levers, but are connected by links 30 to the chassis member.

It has been found that the model suspension system described above functions in substantially the same manner as the real compensated system on which it is modeled and a sense of realism in the suspension system is thereby achieved which would otherwise be lacking. Moreover, the model suspension system functions to provide a combination of equalisation and suspension which enables the model locomotive to ride more smoothly than would otherwise be the case.

Whilst a particular embodiment has been described it will be understood that various modifications can be made without departing from the scope of the invention. For example, the method of locating the coil springs on the tops of the axle bushes or in the bottoms of the dummy leaf springs may be altered. The coil springs, themselves, may be replaced by blocks of rubber or other elastic material. Also, in the case of a scale model of a locomotive which is fitted with a coil spring suspension, it has been found that exact scale reproductions of such coil springs would not lead to suitable springing for the model. Therefore, it has been found preferable to use dummy cast coil springs in conjunction with concealed active coil springs arranged as elements of the model suspension system according to the invention.

I claim:

1. In a model of a locomotive which includes a chassis, wheel axles mounted at parallel spaced positions along said chassis, and an equalized or compensated suspension system comprising means mounting said axles for generally vertically reciprocating movement relatively to said chassis, a set of leaf spring members arranged generally horizontally in spaced relation at a first level along each side of said chassis, a set of suspension lever members disposed between adjacent ones of said leaf spring members and arranged generally horizontally at a second level along each side of said chassis, at least one of said sets of leaf spring members and suspension lever members forming spanning members disposed in spanning relation with said wheel axles respectively, link means arranged generally vertically along each side of said chassis and interconnecting said leaf spring members with adjacent ones of said suspension lever members, holder means fixed to said chassis between each of said spanning members and its respective axle mounting means, each said holder means being open at upper and lower ends adjacent its respective spanning member and axle mounting means, and a pillar member vertically slidable in each said holder means and bearing at upper and lower ends on said respective spanning member and axle mounting means, whereby said suspension system supports said chassis on said wheel axles; means for facilitating small scale modelling of said suspension system with an appearance closely resembling the full size system and functioning similarly thereto, whereby to render said model a more precise reproduction of the full size locomotive, said means comprising said leaf spring members modelled as rigid dummy leaf springs, and said pillar members formed as compression coil springs, each said spanning member bearing on said upper end of its respective holder means for rocking movement thereon, having a recess adjacent said respective holder means in which is engaged the upper end of said coil spring, and being arranged to be movable in a generally vertical direction.

* * * * *